US010820668B2

(12) United States Patent
Wang

(10) Patent No.: US 10,820,668 B2
(45) Date of Patent: Nov. 3, 2020

(54) COMBINED ZIPPER TOP STOP AND PULL TAB SAFETY PROTECTION STRUCTURE AND THE METHOD OF USE THEREOF

(71) Applicant: GENMORE ZIPPER CORPORATION, New Taipei (TW)

(72) Inventor: Lien-Chou Wang, New Taipei (TW)

(73) Assignee: Genmore Zipper Corporation, New Taipei (TW)

( * ) Notice: Subject to any disclaimer, the term of this patent is extended or adjusted under 35 U.S.C. 154(b) by 0 days.

(21) Appl. No.: 16/433,238

(22) Filed: Jun. 6, 2019

(65) Prior Publication Data

US 2020/0015553 A1 Jan. 16, 2020

(30) Foreign Application Priority Data

Jul. 16, 2018 (CN) ..... 2018 2 1141447 U

(51) Int. Cl.
*A44B 19/30* (2006.01)
*A44B 19/26* (2006.01)
*A44B 19/36* (2006.01)

(52) U.S. Cl.
CPC ..... *A44B 19/301* (2013.01); *A44B 19/262* (2013.01); *A44B 19/36* (2013.01)

(58) Field of Classification Search
CPC ..... A44B 19/301; A44B 19/262; A44B 19/36; Y10T 24/2598
See application file for complete search history.

(56) References Cited

U.S. PATENT DOCUMENTS 2,087,045 A * 7/1937 Goodman ..... A41D 1/06 2/228
2,915,798 A * 12/1959 Hewitt, Jr. ..... A44B 19/301 24/387
5,400,480 A * 3/1995 Futch, III ..... A44B 19/301 24/387
2009/0229090 A1* 9/2009 Cossutti ..... A44B 19/32 24/388
2012/0246890 A1* 10/2012 Hernandez ..... A44B 19/301 24/436

* cited by examiner

*Primary Examiner* — Robert Sandy

(57) ABSTRACT

A combined zipper top stop and pull tab safety protection structure includes a left top stop located on a top end of a left zipper tape, a right top stop located on a top end of a right zipper tape, a zipper slider used to close/open the left and right zipper tapes, and a pull tab coupled to the zipper slider, a pin hole located on one of the left and right top stops, a mating pin located on the other of the left and right top stops for engagement with the pin hole, an engagement block located on a top side of one of the left and right top stops, and an engagement hole located on the pull tab for engagement with the engagement block after engagement between the pin hole and the mating pin. The invention relates also to a method of using the combined zipper top stop and pull tab safety protection structure.

7 Claims, 15 Drawing Sheets

COMBINED ZIPPER TOP STOP AND PULL TAB SAFETY PROTECTION STRUCTURE AND THE METHOD OF USE THEREOF

BACKGROUND OF THE INVENTION

1. Field of the Invention

The present invention relates to zipper technology and more particularly, to a combined zipper top stop and pull tab safety protection structure and the method of using the combined zipper top stop and pull tab safety protection structure.

2. Description of the Related Art

Generally speaking, the so-called zipper safety top stops on the market are based on the ultrasonic U-type design or polyoxymethylene (POM) thermoplastic injection molding to prohibit the slider from detachment. However, the lateral pulling force when pulling the pull tab to the top end can only rely on the stopper of the slider to lock the force up to about 7 KG (15 Lbs). This cannot meet the needs of children's wear or packaging, bra zippers, women's back zippers for lateral pull beyond 15 Lbs.

SUMMARY OF THE INVENTION

The present invention has been accomplished under the circumstances in view. It is the main object of the present invention to provide a combined zipper top stop and pull tab safety protection structure and its method of use, which provides an engagement block at the pull tab and an engagement hole at one of the left and right top stops for engagement with the engagement block after interlocking between the left and right top stops to secure the pull tab to the left and right top stops, achieving the security protection of the interlocking of the left, right, upper and lower sides.

It is another object of the present invention to provide a combined zipper top stop and pull tab safety protection structure and its method of use, which prohibits the zipper slider from displacement even if the left and right top stops are accidentally disengaged from each other, ensuring positioning stability of the left and right zipper tapes.

To achieve these and other objects of the present invention, a combined zipper top stop and pull tab safety protection structure comprises a left top stop located on a top end of a left zipper tape, a right top stop located on a top end of a right zipper tape, a zipper slider used to close/open the left and right zipper tapes, and a pull tab coupled to the zipper slider, a pin hole located on one of the left and right top stops, a mating pin located on the other of the left and right top stops for engagement with the pin hole, an engagement block located on a top side of one of the left and right top stops, and an engagement hole located on the pull tab for engagement with the engagement block after engagement between the pin hole and the mating pin. The engagement design between the engagement hole and the engagement block and the engagement design between the pin hole and the mating pin achieve the security protection of the interlocking of the left, right, upper and lower sides.

DETAILED DESCRIPTION OF THE INVENTION

Figure 1:
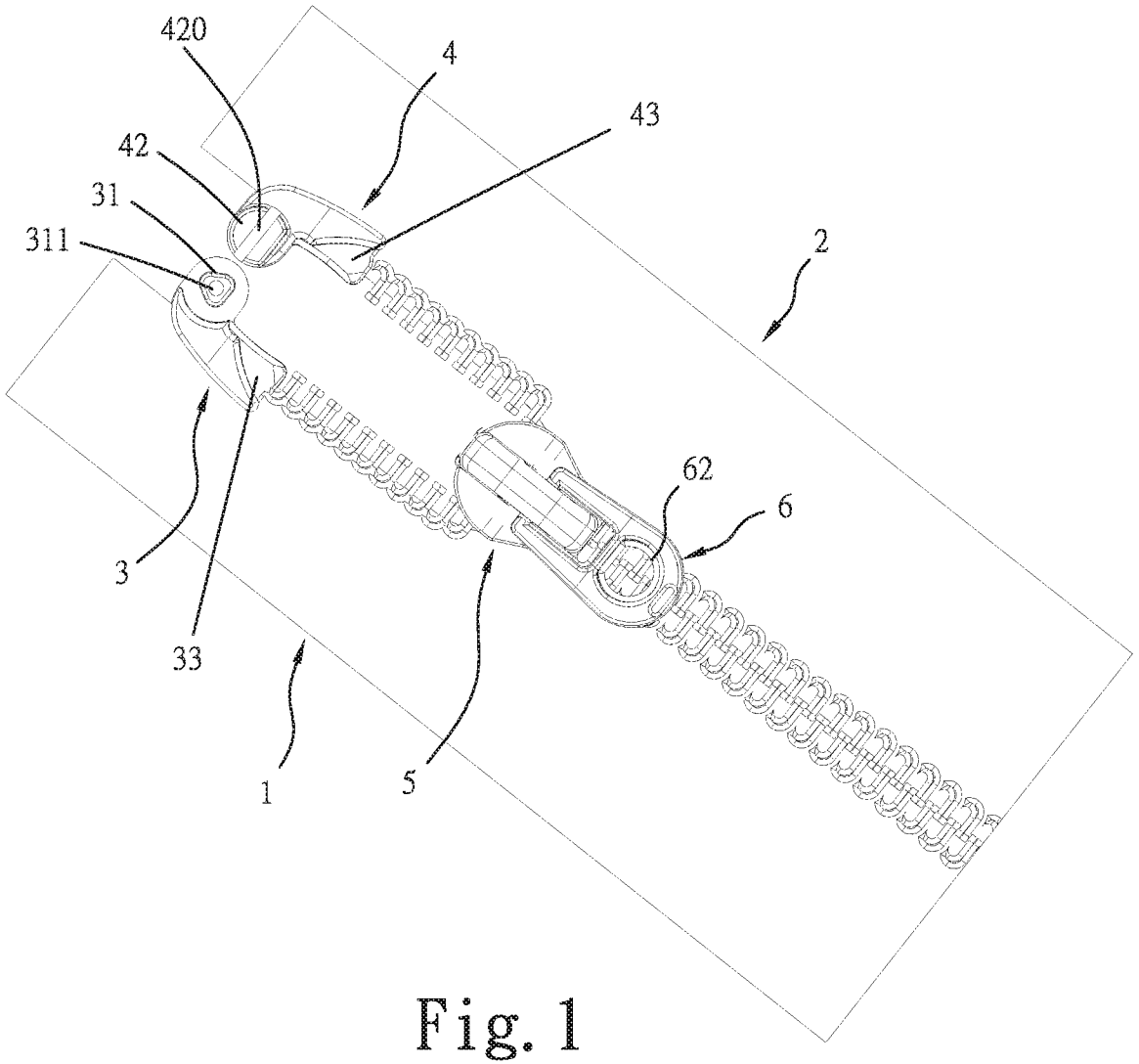
FIG. 1 is a top plain view of a combined zipper top stop and pull tab safety protection structure in accordance with a first embodiment of the present invention.
Figure 2:
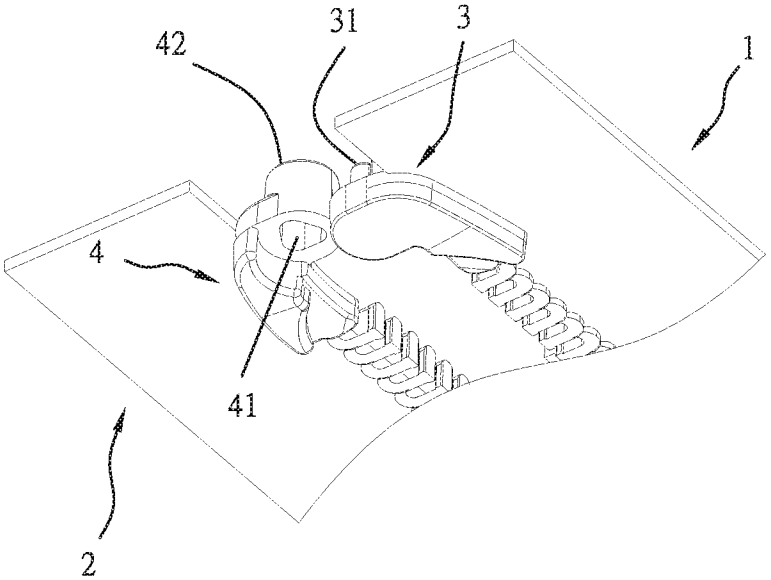
FIG. 2 is a bottom elevational view of a part of the combined zipper top stop and pull tab safety protection structure in accordance with the first embodiment of the present invention.
Figure 3:
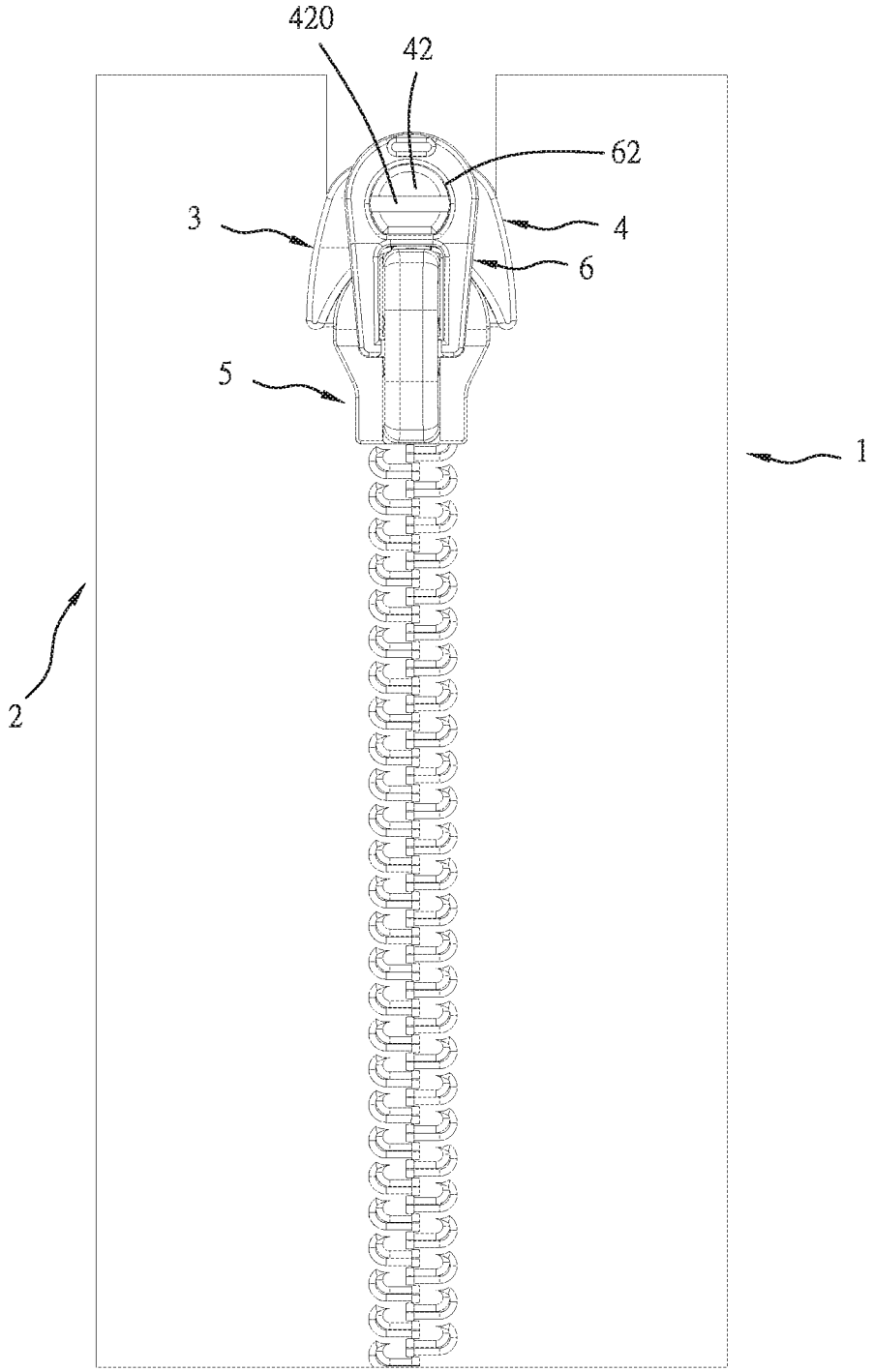
FIG. 3 is a top view of the first embodiment of the present invention, showing the engagement hole of the pull tab engaged with the engagement block.
Figure 4:
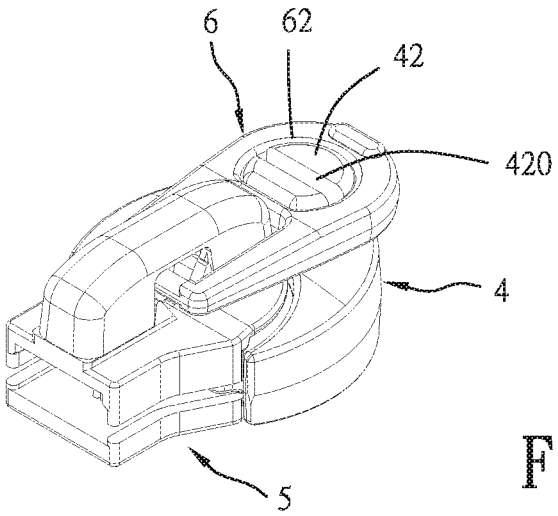
FIG. 4 is an elevational view of a part of the first embodiment of the present invention, showing the left and right top stops engaged together and the engagement hole of the pull tap engaged with the engagement block (the left and right zipper tapes excluded).
Figure 5:
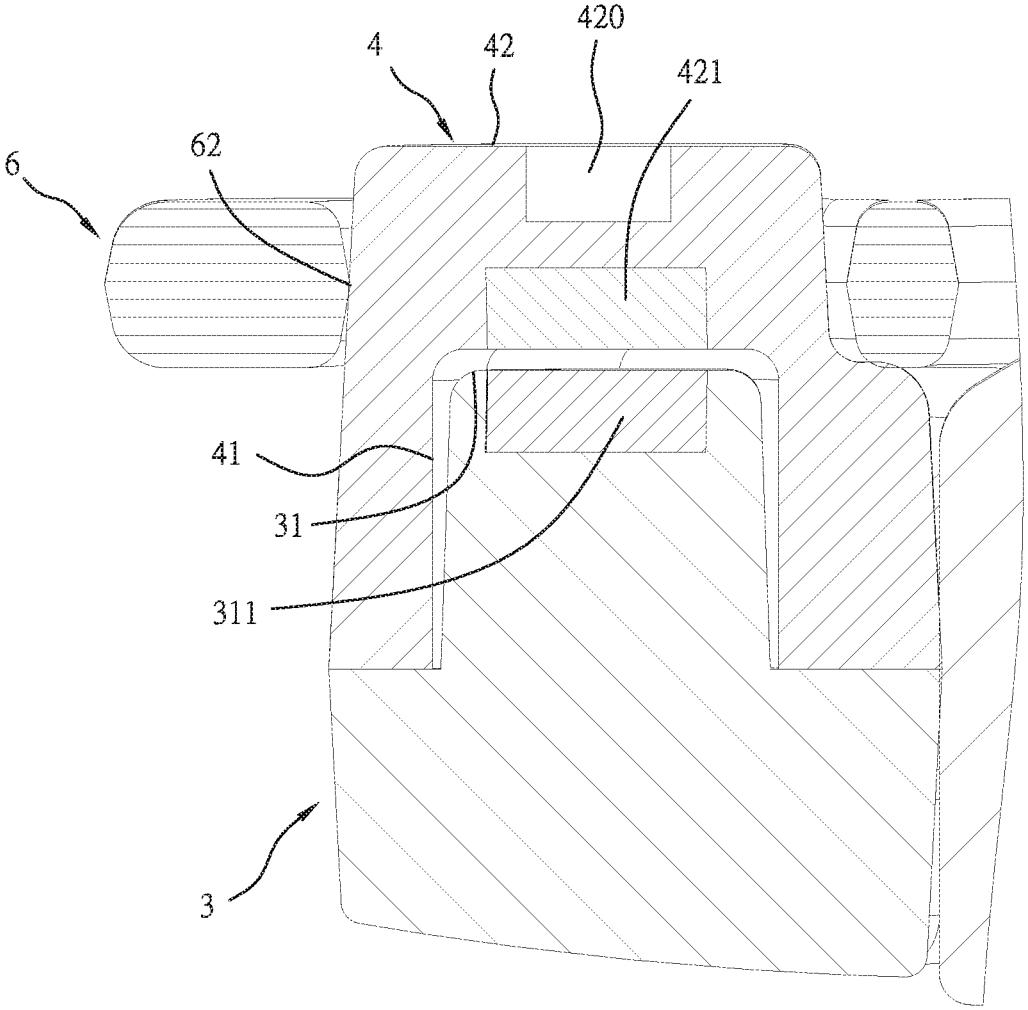
FIG. 5 is a sectional view of a part of the first embodiment of the present invention, showing the left and right top stops engaged together and the engagement hole of the pull tap engaged with the engagement block.

Referring to FIGS. 1-5, a combined zipper top stop and pull tab safety protection structure in accordance with a first embodiment of the present invention comprises a left top stop 3 located on a top end of a left zipper tape 1, a right top stop 4 located on a top end of a right zipper tape 2, a zipper slider 5 used to close/open the left zipper tape 1 and the right zipper tape 2, and a pull tab 6 coupled to the zipper slider 5. The left top stop 3 and the right top stop 4 are made by polyoxymethylene (POM) thermoplastic injection molding, respectively providing a pin hole 41 (see FIG. 2) or a mating pin 31 (see FIG. 5) for interlocking. The pin hole 41 and the pin 31 can be configured having a non-circular cross section, such as triangular or polygonal cross section. After engagement between the pin hole 41 and the pin 31, the right top stop 4 is disposed above the left top stop 3. The right top stop 4 further has an engagement block 42 located on a top surface thereof. The engagement block 42 is provided with at least one transverse groove 420 (refer to FIG. 4 to FIG. 5) to make the engagement block 42 elastic. The zipper slider 5 is an auto lock zipper slider. The pull tab 6 is a rigid material, having an engagement hole 62 for engagement with the engagement block 42 of the right top stop 4 (see FIGS. 3-5). The engagement design between the engagement hole 62 and the engagement block 42 and the engagement design between the pin hole 41 and the pin 31 achieve the security protection of the interlocking of the left, right, upper and lower sides. Magnetic members 311; 421 that are magnetically attractable to each other are respectively provided at the left top stop 3 near the pin 31 and the right top stop 4 near the pin hole 41 (see FIG. 5), enabling the left top stop 3, the right top stop 4 and the pull tab 5 to be secured together.

Figure 6:
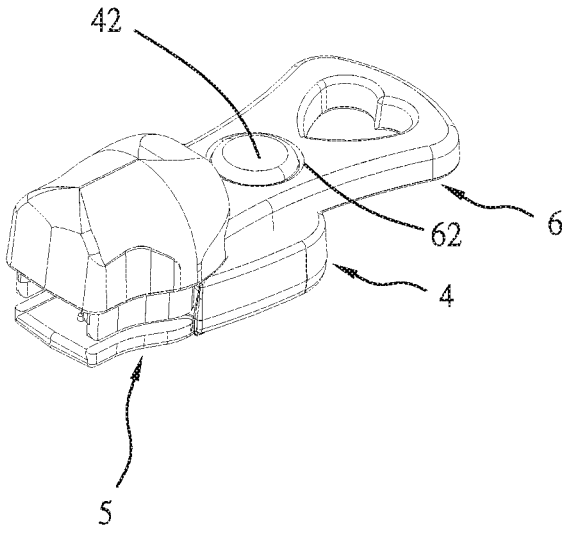
FIG. 6 is a top elevational view of a part of an alternate form of the first embodiment of the present invention, showing the pull tab extended from the no lock zipper slider and the engagement hole of the pull tab engaged with the engagement block.
Figure 7:
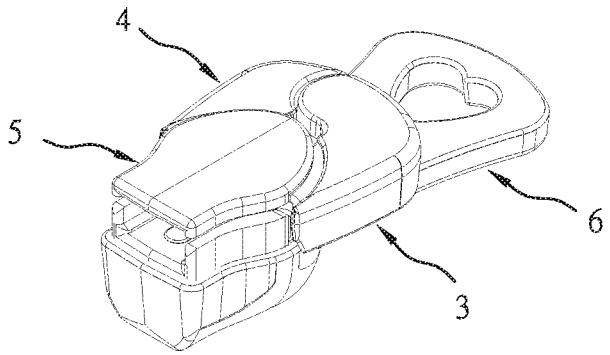
FIG. 7 corresponds to FIG. 6 when viewed from the bottom side.
Figure 8:
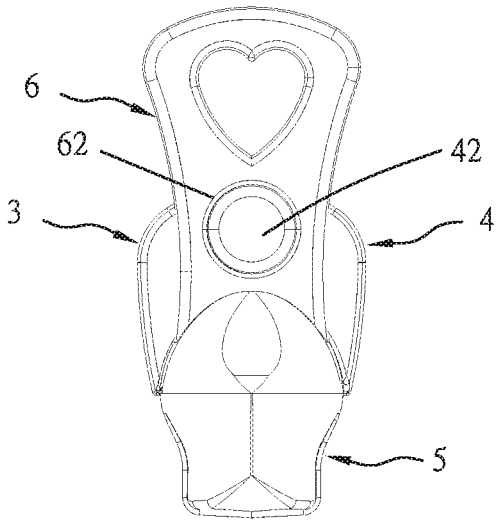
FIG. 8 is a top view showing the pull tab extended from the no lock zipper slider with the engagement hole of the pull tab engaged with the engagement block.
Figure 9:
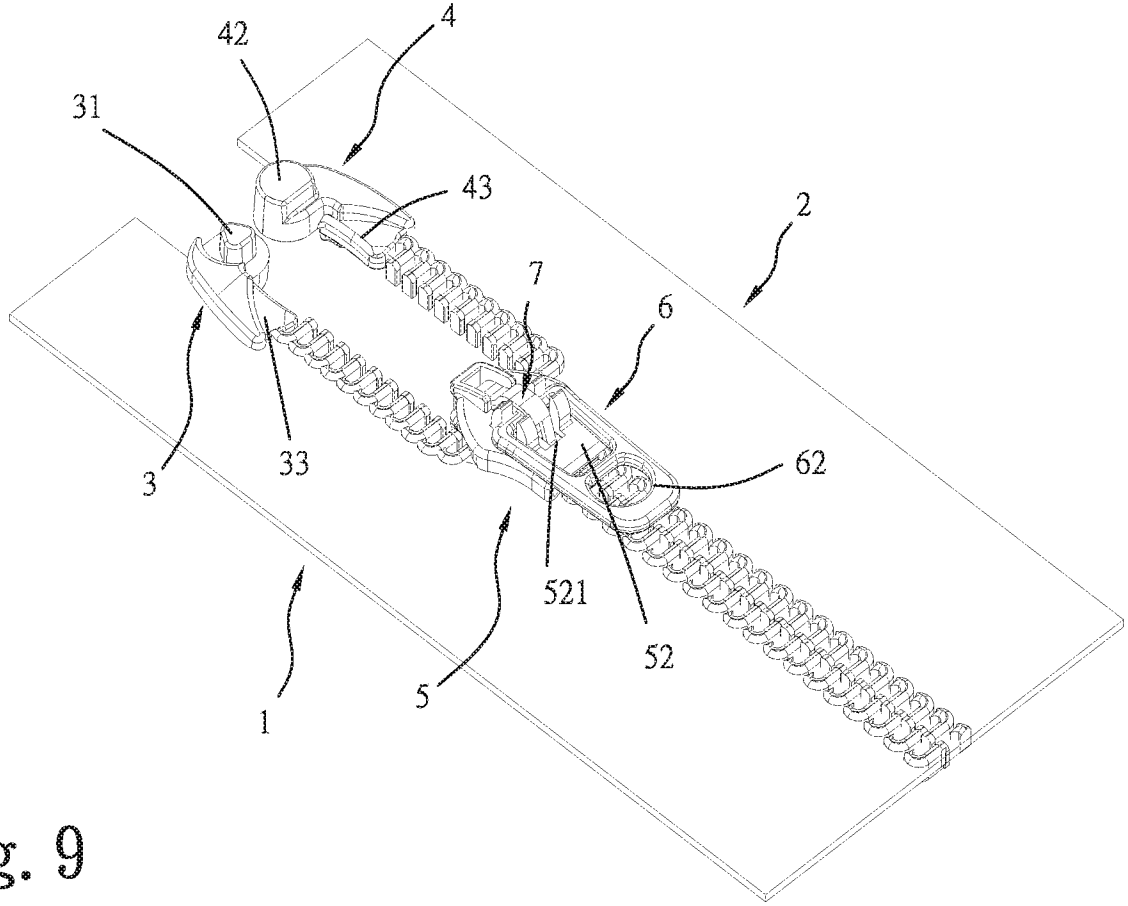
FIG. 9 is an oblique top elevational view of a combined zipper top stop and pull tab safety protection structure in accordance with a second embodiment of the present invention.
Figure 10:
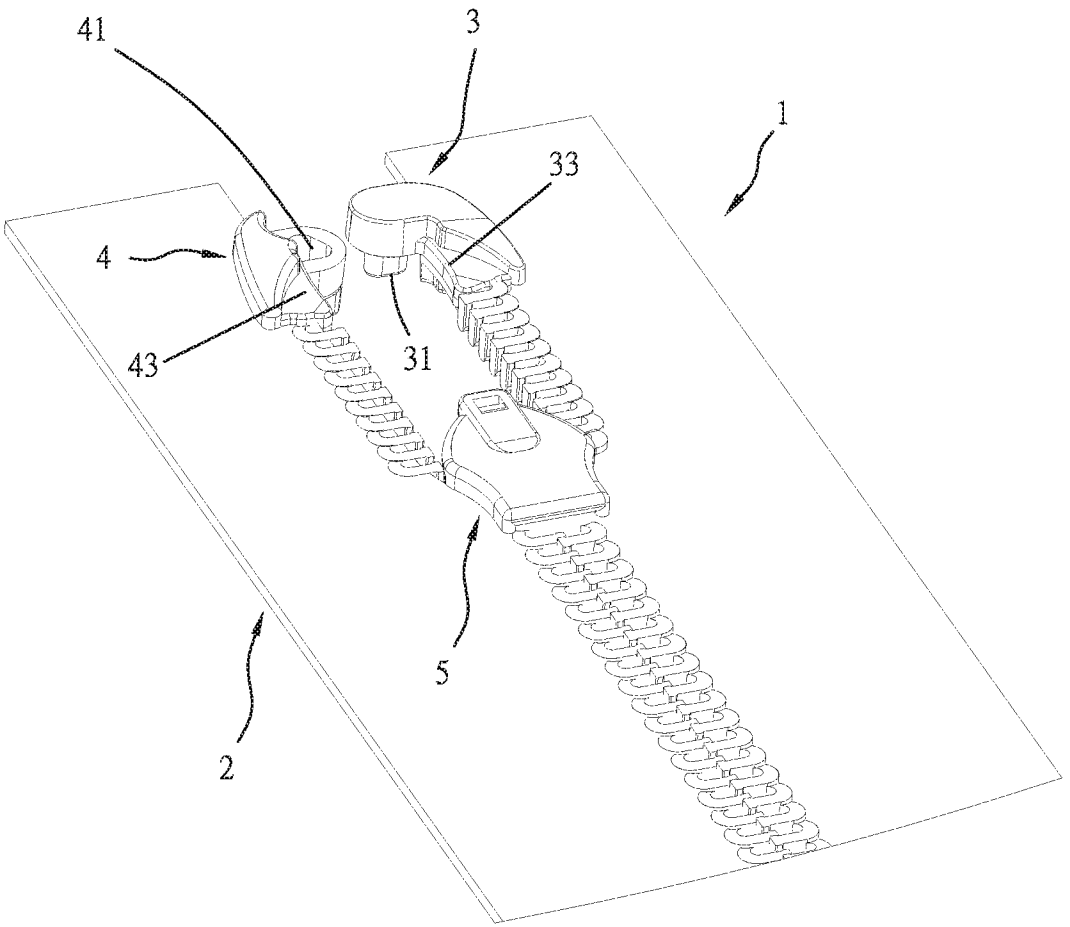
FIG. 10 is an oblique bottom elevational view of the combined zipper top stop and pull tab safety protection structure in accordance with the second embodiment of the present invention.
Figure 11:
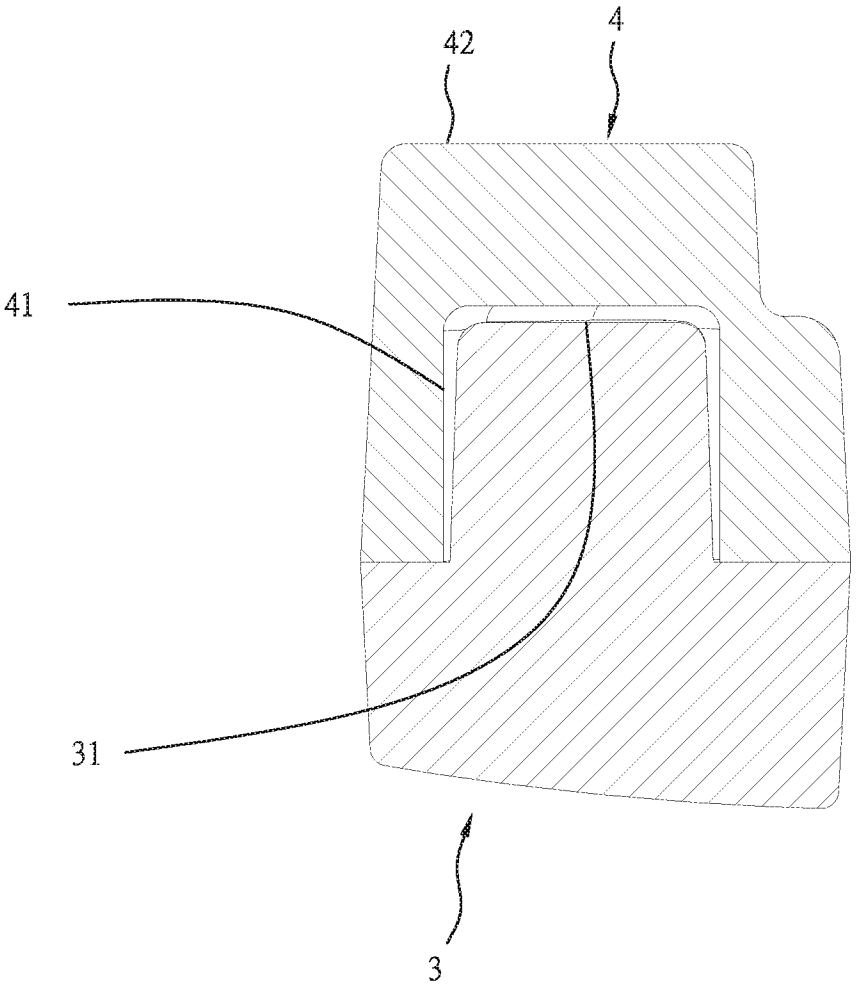
FIG. 11 is a sectional view, in an enlarged scale, of a part of the second embodiment of the present invention, showing the left top stop and the right top stop engaged together.
Figure 12:
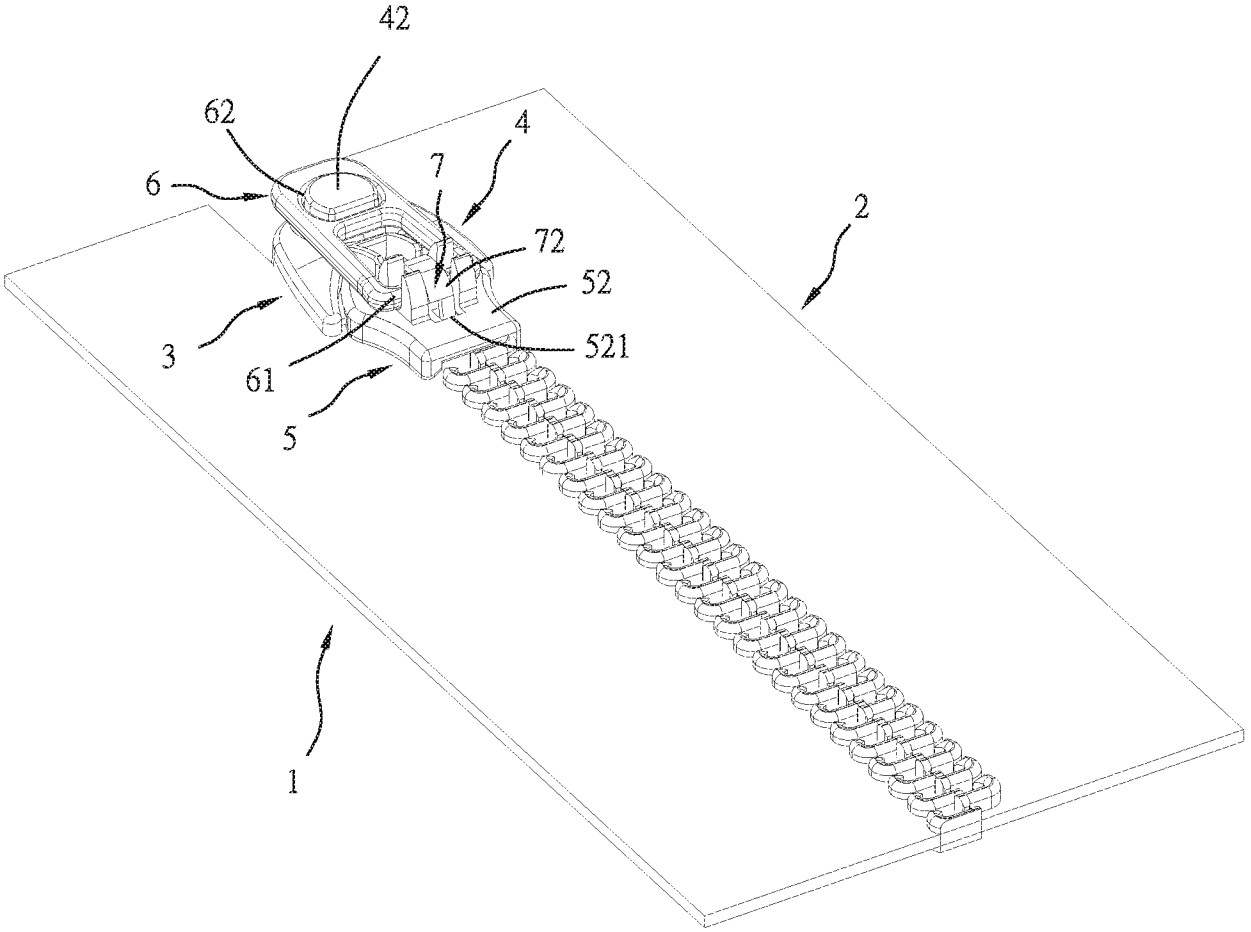
FIG. 12 is an oblique top elevation of the second embodiment of the present invention, showing the left and right top stops engaged together and the engagement hole of the pull tab engaged with the engagement block.
Figure 13:
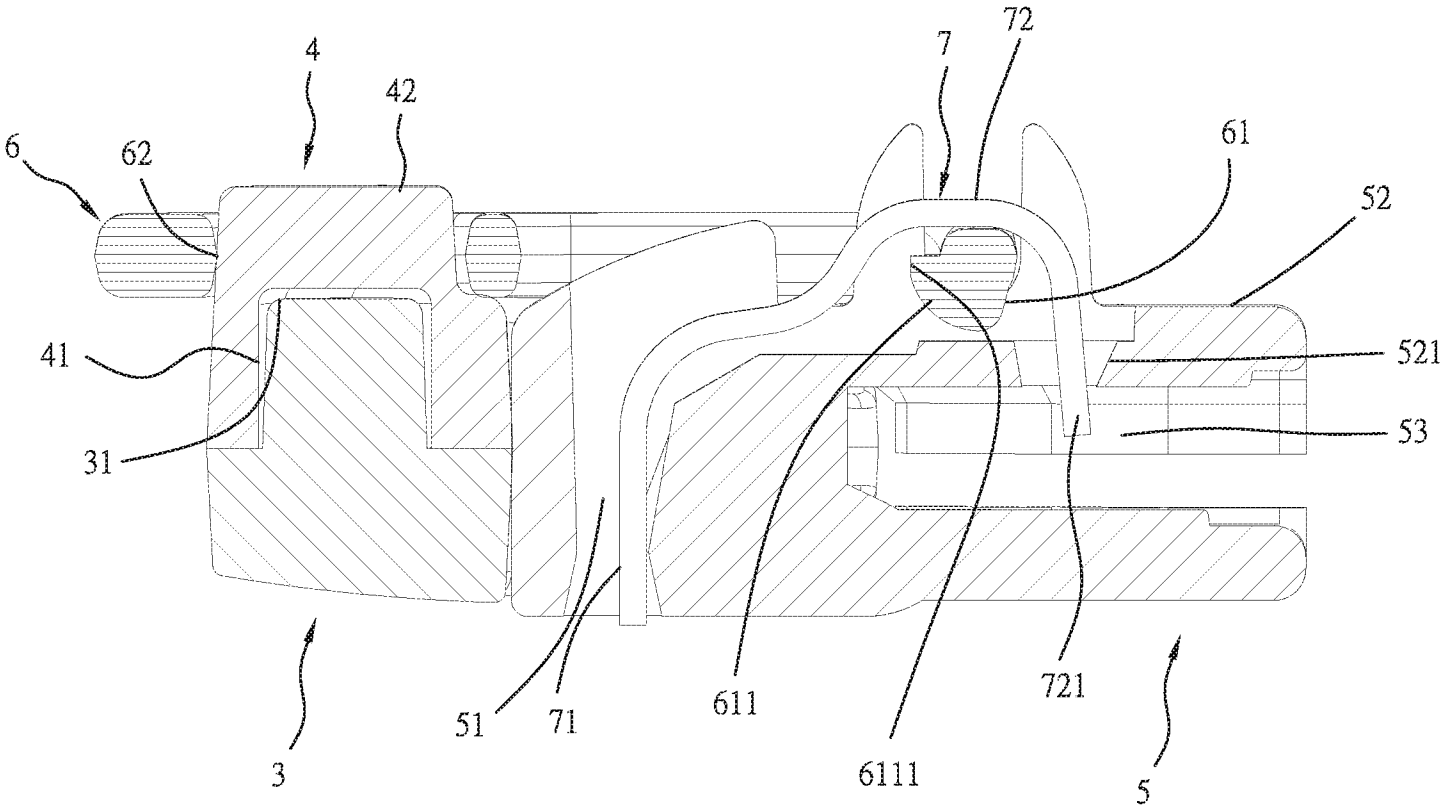
FIG. 13 is a schematic sectional view of a part of the second embodiment of the present invention, showing the left and right top stops engaged together and the engagement hole of the pull tab engaged with the engagement block.
Figure 14:
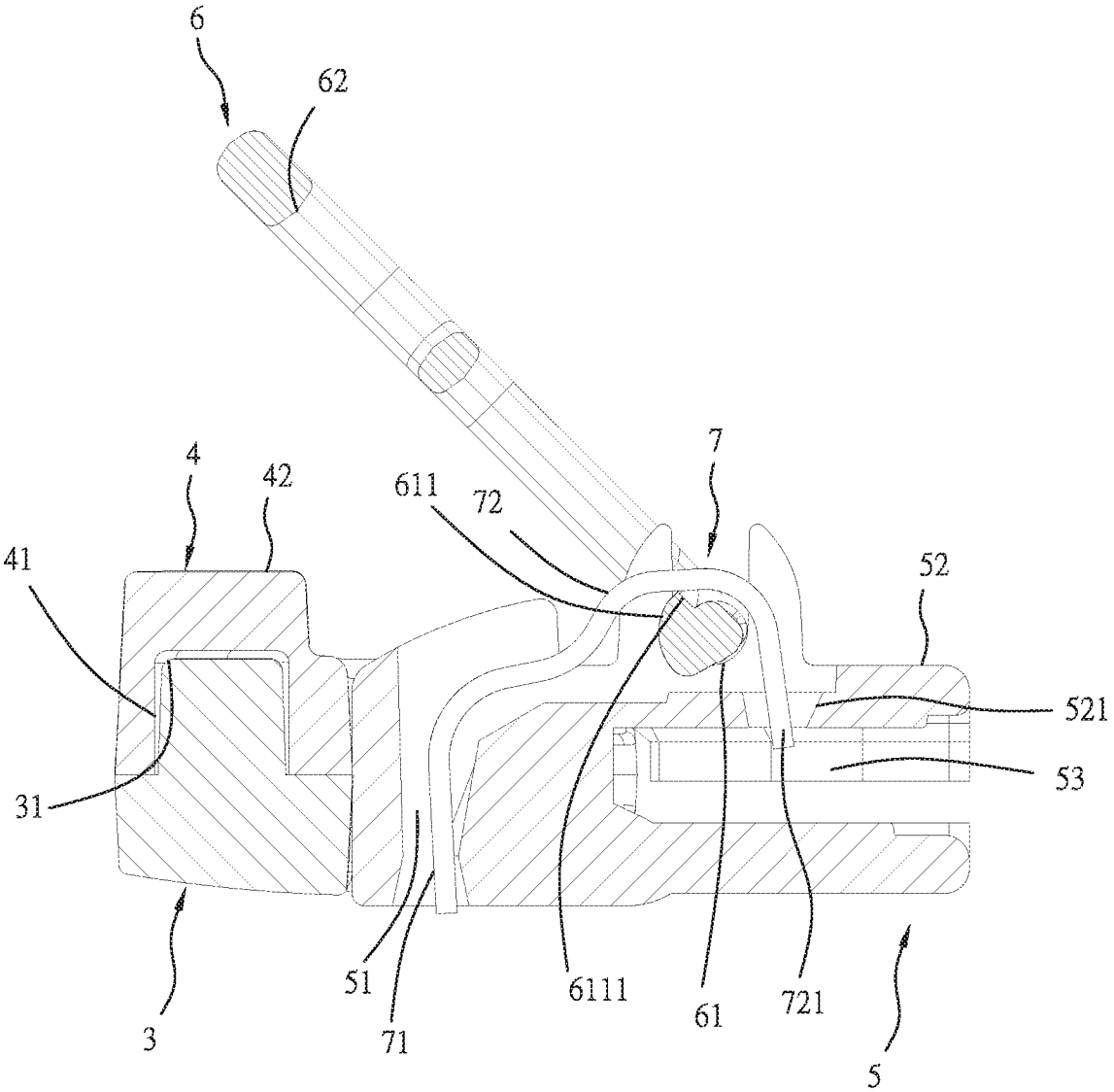
FIG. 14 is a schematic sectional view of a part of the second embodiment of the present invention, showing the reverse cam of the pull tab turned upward to about 45-degree angle.
Figure 15:
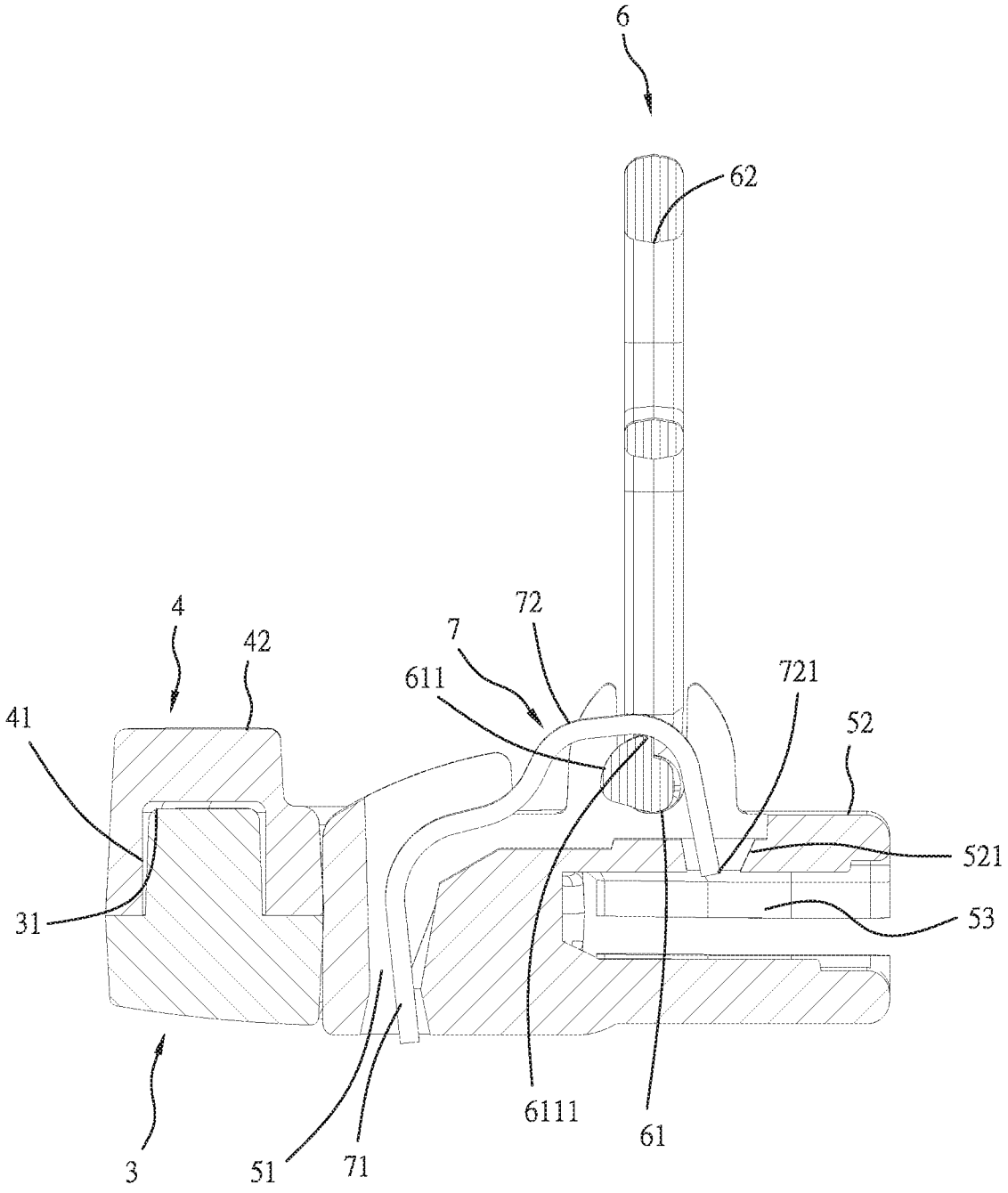
FIG. 15 is a schematic sectional view of a part of the second embodiment of the present invention, showing the plug tip of the spring plate moved by the reversed cam of the pull tab.
Figure 16:
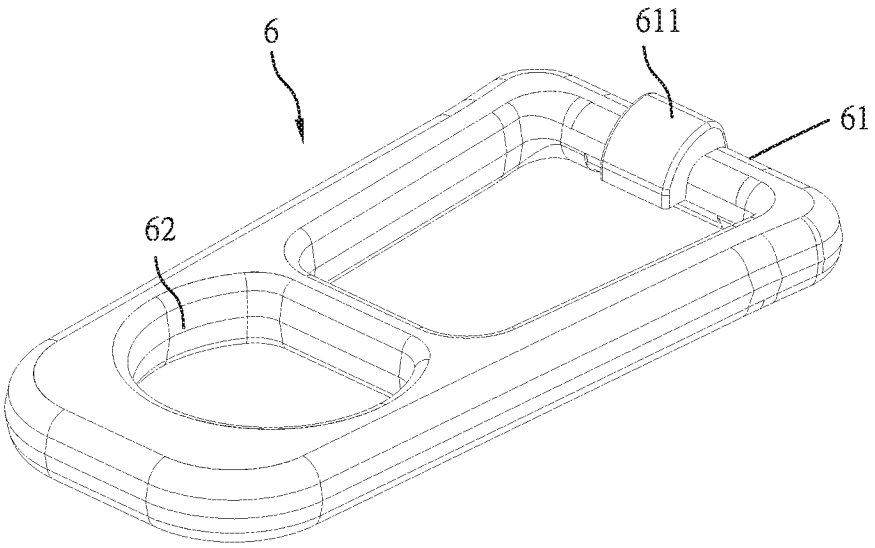
FIG. 16 is an enlarged elevational view of the pull tab in accordance with the second embodiment of the present invention.
Figure 17:
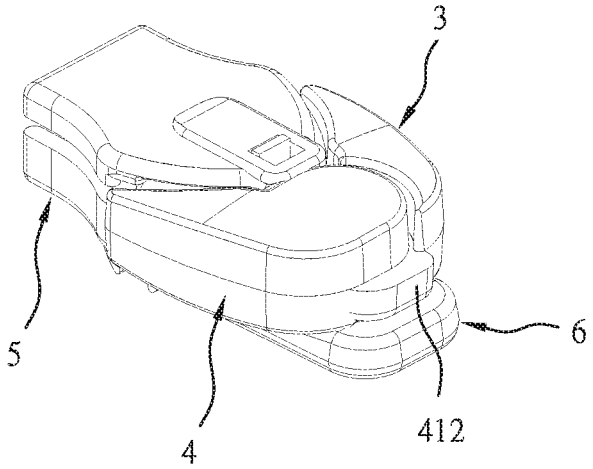
FIG. 17 is an elevational view of a part of the second embodiment of the present invention, showing a finger strip provided at the top end of the right top stop.

Further, in the aforesaid first embodiment, the zipper slider 5 can be a no lock zipper slider that has the pull tab 6 integrally formed therein by insert molding (see FIGS. 6-8). When the left top stop 3 and the right top stop 4 are locked together, the engagement hole 62 of the pull tap 6 is engaged with the engagement block 42 of the right top stop 4. Since the pull tab 6 is made of an elastic material by insert molding. It is elastic, the engagement block 42 of the right top stop 4 does not need to provide the transverse groove 420 shown in FIGS. 3-5.

In a second embodiment of the present invention, the left top stop and right top stop structure is used with a reverse coil zipper YG slider semi auto design.

Referring to FIGS. 9-16, the combined zipper top stop and pull tab safety protection structure comprises a left top stop 3 located on a top end of a left zipper tape 1, a right top stop 4 located on a top end of a right zipper tape 2, a zipper slider 5 used to close/open the left zipper tape 1 and the right zipper tape 2, and a pull tab 6 coupled to the zipper slider 5. The left top stop 3 and the right top stop 4 are made by polyoxymethylene (POM) thermoplastic injection molding, respectively providing a pin hole 41 (see FIG. 10) or a mating pin 31 (see FIG. 11) for interlocking. The pin hole 41 and the pin 31 can be configured having a non-circular cross section, such as triangular or polygonal cross section. After engagement between the pin hole 41 and the pin 31, the right top stop 4 is disposed above the left top stop 3. The right top stop 4 further has an engagement block 42 located on a top surface thereof. The engagement block 42 can be aesthetically pleasing for any shape. The pull tab 6 has an engagement hole 62 located on one end thereof, a transverse bar 61 located on an opposite end thereof, and a reverse cam 611 located on the transverse bar 61 (see FIG. 16). Further, a spring plate 7 is provided having one end 71 thereof affixed to the zipper slider 5 and an opposite end 72 thereof movable relative to the zipper slider 5 (see FIGS. 13-15). When the reverse cam 611 is turned upward with the pull tab 6 to a predetermined angle such as about 45° (see FIG. 14), it locks the pull tab 6 where the engagement hole 62 is engaged with the engagement block 42 (see FIG. 13) to achieve the security protection of the interlocking of the left, right, upper and lower sides.

Further, the zipper slide 5 has a locating hole 51 (see FIGS. 13-15) for the mounting of the spring plate 7. The one end 71 of the spring plate 7 is affixed to an inside wall of the locating hole 51. The opposite end 72 of the spring plate 7 is curved for engagement with the reverse cam 611 at the transverse bar 61 of the pull tab 6 and terminating in a plug tip 721 (see FIGS. 13-15) for insertion into an insertion hole 521 on a top wall 52 of the zipper slider 5. The insertion hole 521 is in communication with an internal cavity 53 of the zipper slider 5 (see FIGS. 13-15). The opposite end 72 of the spring plate 7 can be inserted into or moved out of the internal cavity 53 of the zipper slider 5. Please refer to FIG. 14. When the reverse cam 611 of the pull tab 6 is turned upward by 45-degree angle, the spring force of the spring plate 7 holds down the pull tab 6. Please refer also to FIG. 7, when the reverse cam 611 is continuously turned upward, the cam portion 6111 of the reverse cam 611 of the pull tab 6 forces the plug tip 721 of the other end 72 of the spring plate 7 away from the internal cavity 53 of the zipper slider 5 (see FIG. 15), thus, the plug tip 721 is disengaged from the locating teeth (not shown) in the internal cavity 53, allowing free movement of the zipper slider 5.

The right top stop 4 further provides a finger strip 412 at a top end thereof. Through the finger strip 412, the right top stop 4 can be conveniently operated with the finger or fingernail to disengage the pin hole 41 from the pin 31 of the left top stop 3.

The method of using the combined zipper top stop and pull tab safety protection structure in accordance with the present invention includes the steps of:

a. Force the pin 31 of the left top stop 3 into engagement with the pin hole 41 of the right top stop 4 manually (see FIG. 11).
b. Move the zipper slider 5 to the box (not shown) and insert the pin (not shown) into the box, and then pull the zipper slider 5 to close the left and right zipper tapes, and then force the engagement hole 62 of the pull tab 6 into engagement with the engagement block 42 of the right top stop 4 (see FIGS. 12 and 13).
c. In the aforesaid procedures, the reverse cam 611 at the transverse bar 61 of the pull tab 6 is turned upward to about 45-degree angle relative to the spring plate 7 (see FIG. 14), causing the engagement hole 62 of the pull tab 6 to be forced into engagement with the engagement block 42 of the right top stop 4 to prohibit the zipper slider 5 from displacement. At the same time, a latch portion 33 of the left top stop 3 and a latch portion 43 of the right top stop 4 are inserted into the internal cavity 53 of the zipper slider 5 to stop the zipper slider 5 from displacement. Subject to the engagement between the engagement hole 62 and the engagement block 42 and the engagement between the pin hole 41 and the pin 31, the left top stop 3 and the right top stop 4 are prohibited from relative movement horizontally and vertically, maintaining the lateral force stability.
d. When dismounting the zipper, use the fingers to disengage the engagement hole 62 of the pull tab 6 from the engagement block 42 of the right top stop 4 so as to unlock the zipper slider 5, then move the zipper slider 5 downward for a small distance, and then use the finger or fingernail to lift the finger strip 412 of the right top stop 4 in disengaging the pin hole 41 of the right top stop 4 from the pin 31 of the left top stop 3.

e. Separate the left and right zipper tapes to disengage the pin from the box.

In conclusion, the invention can be summarized as follows:

1. The pull tab 6 of the zipper slider 5 can be reversed to force the engagement hole 62 into engagement with the engagement block 42 of the right top stop 4 after engagement between the left top stop 3 and the right top stop 4, achieving the security protection of the interlocking of the left, right, upper and lower sides.

2. Even if the left top stop 3 and the right top stop 4 are accidentally disengaged from each other, the zipper slider 5 is still locked to the right top stop 4 subject to the engagement between the engagement block 42 and the engagement hole 62, maintaining positioning stability between the left zipper tape 1 and the right zipper tape 2.

What is claimed is:

1. A combined zipper top stop and pull tab safety protection structure, comprising:

a left top stop located on a top end of a left zipper tape, a right top stop located on a top end of a right zipper tape, a zipper slider used to close and open said left zipper tape and said right zipper tape, and a pull tab coupled to said zipper slider, wherein said left top stop and said right top stop are made by polyoxymethylene (POM) thermoplastic injection molding, respectively providing a pin hole or a mating pin for interlocking, said pin hole and said mating pin having a non-circular cross section.

2. The combined zipper top stop and pull tab safety protection structure as claimed in claim 1, further comprising an engagement block located on a top side of one of said left top stop and said right top stop, and an engagement hole located on said pull tab for engagement with said engagement block, said engagement block having a transverse groove to make said engagement block elastic, said pull tab being a rigid material.

3. The combined zipper top stop and pull tab safety protection structure as claimed in claim 2, further comprising two magnetic members respectively provided at said left top stop and said right top stop and magnetically attractable to each other to secure said left top stop and said right top stop together after engagement between said mating pin and said pin hole.

4. The combined zipper top stop and pull tab safety protection structure as claimed in claim 1, further comprising an engagement block located on a top side of one of said left top stop and said right top stop, and an engagement hole located on said pull tab for engagement with said engagement block, said pull tab being made of an elastic material.

5. The combined zipper top stop and pull tab safety protection structure as claimed in claim 1, further comprising an engagement block located on a top side of one of said left top stop and said right top stop, and an engagement hole located on said pull tab for engagement with said engagement block, wherein said pull tab comprises said engagement hole located on one end thereof, a transverse bar located on an opposite end thereof and a reverse cam located on said transverse bar; said zipper slider further comprises a spring plate for engagement with said reverse cam when said reverse cam is turned upward with said pull tab relative to said zipper slider to about 45-degree angle.

6. The combined zipper top stop and pull tab safety protection structure as claimed in claim 5, further comprising a finger strip protruded from a top end of one of said left top stop and said right top stop that is disposed at a top side after engagement between said pin hole and said mating pin, said finger strip being liftable by a finger or a fingernail to disengage said pin hole from said mating pin; said zipper slider further comprises a locating hole, an internal cavity and an insertion hole in communication with said internal cavity; said spring plate has one end thereof affixed to an inside wall of said locating hole of said zipper slider and an opposite end thereof curved for engagement with said reverse cam outside said zipper slider, said opposite end of said spring plate being terminating in a plug tip for insertion through said insertion hole into said internal cavity.

7. A method of using a combined zipper top stop and pull tab safety protection structure as claimed in claim 1, comprising the steps of:

forcing said mating pin of one of said left and right top stops into engagement with said pin hole of the other of said left and right top stops manually;

moving said zipper slider to a box and insert the pin of the zipper into the box, and then pulling said zipper slider to close said left and right zipper tapes, and then forcing said engagement hole of said pull tab into engagement with said engagement block, and then biasing said pull tab to turn a reverse cam upward to about 45-degree angle relative to a spring plate to force a latch portion of said left top stop and a latch portion of said right top stop into an internal cavity of said zipper slider to stop said zipper slider from displacement;

when dismounting the zipper, using the fingers to disengage said engagement hole of said pull tab from an engagement block at one of said left and right top stops so as to unlock said zipper slider from said left and right top stops, and then using the finger or fingernail to lift a finger strip to disengage said pin hole from said mating pin; and separating said left and right zipper tapes to disengage the pin from the box.

* * * * *